US006719616B2

(12) United States Patent
Mathison et al.

(10) Patent No.: US 6,719,616 B2
(45) Date of Patent: Apr. 13, 2004

(54) RAIL GRINDING APPARATUS

(75) Inventors: Dennis R. Mathison, Maple Plain, MN (US); Donald L. Minge, Minnetrista, MN (US)

(73) Assignee: Loram Maintenance of Way, Inc., Hamel, MN (US)

( * ) Notice: Subject to any disclaimer, the term of this patent is extended or adjusted under 35 U.S.C. 154(b) by 113 days.

(21) Appl. No.: 09/950,277

(22) Filed: Sep. 10, 2001

(65) Prior Publication Data

US 2002/0094762 A1 Jul. 18, 2002

Related U.S. Application Data

(60) Provisional application No. 60/232,183, filed on Sep. 8, 2000, and provisional application No. 60/253,413, filed on Nov. 28, 2000.

(51) Int. Cl.[7] ..... B24B 1/00; B24B 7/00

(52) U.S. Cl. ..... 451/58; 451/347

(58) Field of Search ..... 15/54, 55, 78; 409/175; 451/57, 58, 347

(56) References Cited

U.S. PATENT DOCUMENTS

| | | | | | |
|---|---|---|---|---|---|
| 3,707,808 | A | * | 1/1973 | Danko et al. | 451/347 |
| 4,829,723 | A | | 5/1989 | Bull et al. | |
| 4,862,647 | A | | 9/1989 | Vieau | |
| 5,525,098 | A | * | 6/1996 | Jaeggi | 451/347 |
| 5,577,954 | A | * | 11/1996 | Okumura et al. | 451/347 |

* cited by examiner

*Primary Examiner*—Timothy V. Eley
(74) *Attorney, Agent, or Firm*—Patterson, Thuente, Skaar & Christensen, P.A.

(57) ABSTRACT

A rail grinding apparatus for use in grinding rails. The rail grinding apparatus includes a transport vehicle and a rail grinding unit. The transport vehicle is capable of moving along the rails or a conventional road. The rail grinding unit is capable of grinding at least one of the rails. The rail grinding unit is movable between a stored position on the transport vehicle and a deployed position on the rails.

24 Claims, 2 Drawing Sheets

RAIL GRINDING APPARATUS

REFERENCE TO RELATED APPLICATIONS

This application claims the benefit of United States provisional patent application Serial No. 60/232,183, filed Sep. 8, 2000, and No. 60/253,413 filed Nov. 28, 2000, the disclosures of which are incorporated herein by this reference.

FIELD OF THE INVENTION

The present invention generally relates to a rail grinding apparatus. More particularly, the present invention relates to an easily transportable rail grinding apparatus.

BACKGROUND OF THE INVENTION

Railroad tracks are subject to wear by the passage of trains over the rails. In particular, depressions in the upper surface of a rail may develop such that the rail head presents an undulating, corrugated surface. The rail may also develop burrs, or otherwise lose its symmetrical profile.

Maintaining a smooth running surface is important for a variety of reasons including safety, riding comfort, protection of the track, track bed and rolling stock, noise suppression, and reduced maintenance of the track and track bed.

It is known to use grinding machines for maintaining railroad track rails in smooth, properly shaped condition. Examples of two such rail grinding machines are disclosed in U.S. Pat. Nos. 4,829,723 and 4,862,647, both of which are assigned to the assignee of the present application.

Such grinding machines generally include a plurality of rotatable grinding modules that are carried by a locomotive or the like in close proximity to the rail head surfaces of a railroad track. The grinding modules include rotatable, abrasive grinding stones that can be lowered into a position flush with the rail surface to grind and restore the rail surface to a smooth, desired profile.

The grinding modules include replaceable, abrasive grinding stones that are rotated about a grinding axis. The grinding stones preferably have a generally flat, annular grinding surface, which is located perpendicular to the axis of rotation of the grinding stones. While the grinding surface of the grinding stone is worn by the grinding process, the grinding surface can be maintained essentially flat and perpendicular to the grinding axis by grinding only on an inner diameter of the grinding stone. Using this process, the grinding surface is placed on the rail so that the rail sides do not extend beyond the inner diameter of the grinding stone.

It can be preferable in some situations to have the grinding marks left by the grinding stone on the rail head be perpendicular to a longitudinal axis of the rail. Such perpendicular grinding marks are left when the grinding is done on the inner diameter of the grinding stone. More precisely, perpendicular grinding marks are left on the rail head when the line of contact between the grinding stone and the rail head is along a diameteral line of the grinding stone, perpendicular to and intersecting the grinding axis of rotation.

Another consideration when grinding rails to a desired profile is the presence of obstructions to the grinding stone. For example at road crossings, where the track intersects a street, wooden ties or rubber guards are typically mounted in close proximity of the track to allow for smooth passage of wheeled vehicles across the track rails. Tilting of the grinding modules to shape the profile of the rail head can bring the grinding stones into interfering contact with the wooden ties or rubber guards.

Another portion of railroad tracks that poses a particularly challenge to maintain in a smooth condition is switches where different set of tracks come together. Undulations in the rail surfaces can impart vibratory motion to rolling stock that will continue long after the train has passed to switch. However, the converging nature of the rails at switches presents a barrier to the use of most conventional rail grinding machines.

Jaeggi, U.S. Pat. No. 5,525,098 discloses a rail grinding apparatus that includes a transport vehicle that is capable of moving on rails and conventional roads. The rail grinding apparatus also includes a rail grinder that is towed behind the transport vehicle. The transport vehicle includes a lift mechanism that lifts the rail grinder off the rails to facilitate transporting the rail grinder to a location where the rail grinder is to be used.

SUMMARY OF THE INVENTION

The present invention relates to a rail grinding apparatus for use in grinding rails. The rail grinding apparatus includes a transport vehicle and a rail grinding unit. The transport vehicle is capable of moving along the rails or a conventional road. The rail grinding unit is capable of grinding at least one of the rails. The rail grinding unit is movable between a stored position on the transport vehicle and a deployed position on the rails.

The present invention also relates to a method of grind rails. The method includes providing a transport vehicle that is capable of moving along rails and a conventional road. A rail grinding unit is placed in a stored position on the transport vehicle. The rail grinding unit is moved from the stored position to a deployed position on the rails. At least one of the rails is grinded with the rail grinding unit.

DETAILED DESCRIPTION OF PREFERRED EMBODIMENTS

Figure 1:
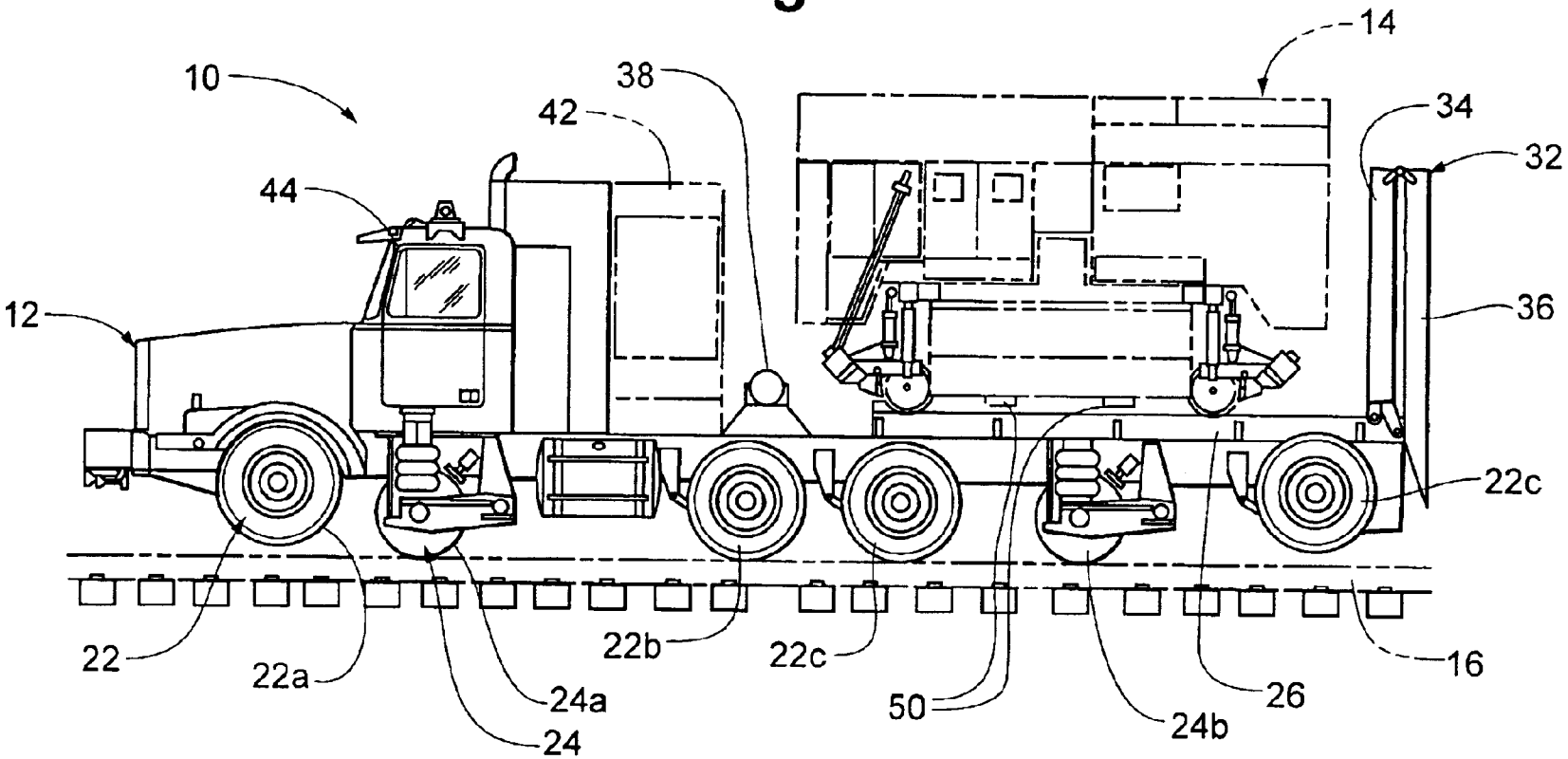
FIG. 1 is a side view of the rail grinding apparatus with a rail grinding unit in a stored position.

The present invention relates to a rail grinding apparatus, as generally indicated at 10 in FIG. 1. The rail grinding apparatus 10 generally includes a transport vehicle 12 and a rail grinding unit 14.

The rail grinding apparatus 10 is particularly suited for grinding rails on main line railroads as well as on transit systems. While it is possible to use the rail grinding apparatus 10 of the present invention for grinding large lengths of track, the rail grinding apparatus is particularly suited for use in performing smaller grinding operations at selected locations.

The transport vehicle 12 includes a frame 20. Attached to the frame 20 are a first set of wheels 22 and a second set of wheels 24. The first set of wheels 22 is particularly adapted for use when the rail grinding apparatus 10 is moved over a conventional road surface.

The first set of wheels 22 includes front wheels 22*a* that are rotatably and pivotably mounted to the frame 20. The first set of wheels 22 also includes rear wheels 22*b* that are rotatably mounted to the frame 20. The rear wheels 22*b* are preferably connected to an internal combustion engine (not shown), which provides the necessary power to cause rotation of the rear wheels 22*b* for moving the rail grinding apparatus 10. Depending on the weight of the transport vehicle 12 and the rail grinding unit 14 and the vehicle load restrictions in the regions where the rail grinding apparatus 10 will be operated, the transport vehicle 12 may include additional front wheels (not shown) and/or rear wheels 22*c*.

The second set of wheels 24 is particularly adapted for use when the rail grinding apparatus 10 is moved along rails 16. The second set of wheels 24 is movable between a retracted position and an extended position. Movement of the second set of wheels 24 between the retracted position and the extended position is preferably controlled by a hydraulic system. A person of ordinary skill in the art will appreciate that a suitable hydraulic system may be selected based upon the number of wheels, the weight of the transport vehicle 12 and the weight of the rail grinding unit 14.

The second set of wheels 24 includes front wheels 24*a* and rear wheels 24*b* that are both rotatably mounted to the frame 20. The front wheels 24*a* and the rear wheels 24*b* have a structure that is suitable for engaging the rails 16.

When in the retracted position, a lower surface of the wheels in the first set of wheels 22 is lower than a lower surface of the wheels in the second set of wheels 24 so that the second set of wheels 24 do not contact the road surface as the rail grinding apparatus 10 is moved along the road surface.

When in the extended position, the lower surface of the wheels in the second set of wheels 24 is at or lower to the lower surface of the wheels in the first set of wheels 22. The lower surface of the front wheels 24*a* is preferably below the lower surface of the front wheels 22*a* when the first set of wheels is in the extended position so that the front wheels 22*a* are raised above the rails 16. The lower surface of the back wheels 22*b* is preferably at approximately the same height as the lower surface of the back wheels 24*b* so that back wheels 22*b* and back wheels 24*b* both engage the rails 16. Rotation of the back wheels 22*b* thereby causes the second set of wheels to roll along the rails 16 to move the transport vehicle 12 along the rails 16.

The transport vehicle 12 also includes a pair of rails 26 attached to the frame 20. The pair of rails 26 supports the rail grinding unit 14 when the rail grinding unit 14 is stored on the transport vehicle 12.

Figure 2:
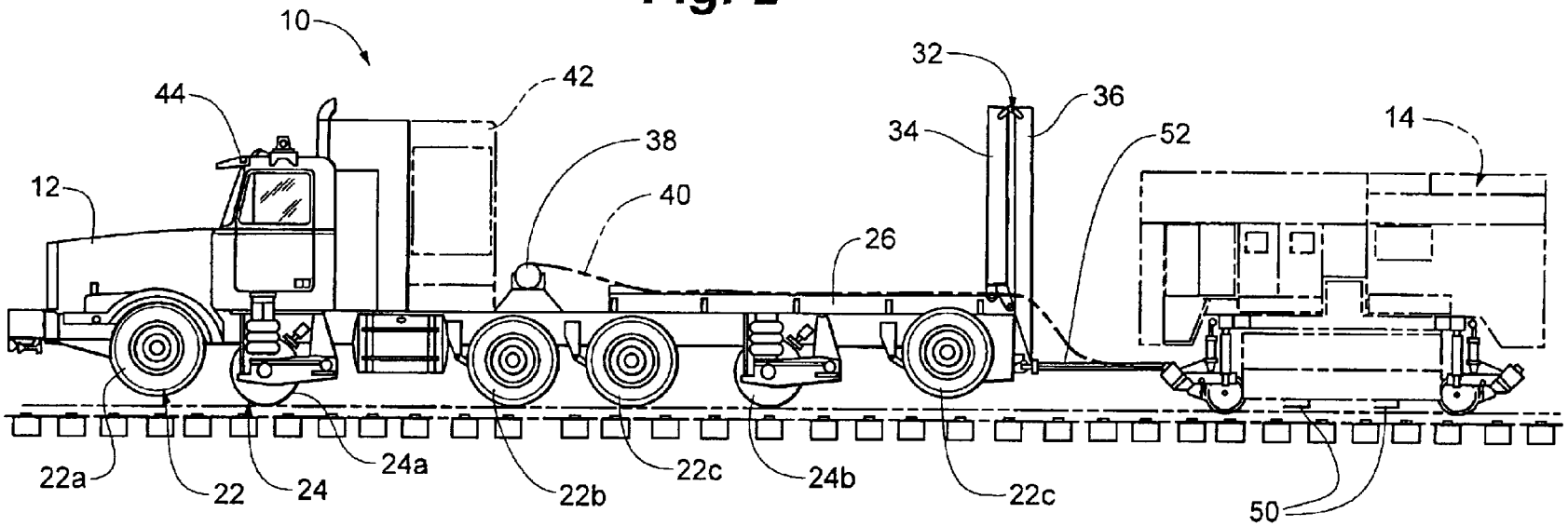
FIG. 2 is a side view of the rail grinding apparatus with the rail grinding unit in a fully deployed position.

Extending from a back end of the pair of rails 26 is a ramp 32, which enables the rail grinding unit 14 to be moved from the stored position on the transport vehicle 12 to the deployed position on the rails 16. The ramp 32 is preferably fabricated in a two-part configuration that includes a first section 34 and a second section 36. The first section 34 is pivotably attached to the frame 20 and the second section 36 is pivotably attached to the first section 34. The ramp 32 is thereby movable between a retracted position, as illustrated in FIG. 1, to an extended position, as illustrated in FIG. 2. When in the extended position, the ramp 32 provides a relatively smooth top surface that allows the rail grinding unit 14 to roll off the transport vehicle 12 and onto the rails 16.

Pivoting of the ramp 32 between the retracted position and the extended position is preferably controlled by a hydraulic system (not shown). A person of ordinary skill in the art will appreciate that a suitable hydraulic system may be selected based upon the weight of the first section 34 and the second section 36.

To facilitate moving the rail grinding unit 14 between the stored position and the deployed position, the transport vehicle 12 includes a winch 38 with a cable 40 extending therefrom.

The transport vehicle 12 also preferably includes a generator 42 mounted to the frame 20. The generator 42 produces electricity to power the operation of the rail grinding unit 14.

The transport vehicle 12 further preferably includes an operator enclosure 44. The operator enclosure 44 preferably has a seat (not shown) and controls needed to operate the rail grinding apparatus 10 while moving on the road surface and on the rails 16 when the rail grinding unit 14 is grinding the rails 16. To facilitate use of the rail grinding apparatus 10, a touch screen mechanism (not shown) is preferably provided in the operator enclosure 44 to control the grinding process. Preferably, the transport vehicle 12 includes at least one video camera and an associated display so that the grinding process may be monitored from within the operator enclosure 44.

As an alternative to forming the transport vehicle 12 that permits the rail grinding unit 14 to be placed thereon, the transport vehicle 12 may be used to just tow the rail grinding unit 14. In this embodiment, the transport vehicle 12 may be a rail bound power car such as a locomotive.

To facilitate use of the rail grinding apparatus 10 in metropolitan areas, the rail grinding apparatus 10 preferably includes an exhaust scrubber to reduce exhaust emissions.

The rail grinding unit 14 preferably includes four grinding modules 50. The grinding modules 50 preferably include an offset type grinding capability. Examples of grinding modules that are suitable for use in the present invention are disclosed in Mathison et al., U.S. Pat. No. 6,033,291, which is assigned to the assignee of the present application.

To enable the rail grinding unit 14 to be used on rails having different gauges, the rail grinding unit 14 may be configured to have two groups of grinding modules 50 that are mounted to permit the spacing to be adjusted. The adjustment to different spacings may either be controlled manually or automatically.

The rail grinding unit 14 also preferably includes a dust collection system that gathers and retains grinding dust. The dust collection system thereby minimizes the dust emitted during the grinding process.

The rail grinding unit 14 further preferably includes spark controlling blankets to reduce the potential of sparks generated from the grinding process to cause fires. The spark controlling blankets are preferably panels that extend downwardly adjacent the grinding units 50. Other suitable mechanism for controlling sparks and dust residue are disclosed in Shoenhair et al., U.S. Pat. No. 5,111,624, which is assigned to the assignee of the present application.

Additionally, the rail grinding unit 14 has a noise suppression system that reduces the noise emitted during the grinding process so that the rail grinding apparatus 10 may be used in metropolitan areas.

In operation, the rail grinding apparatus 10 is transported to a location proximate to where it is desired to grind rails by driving the transport vehicle 12 over road surfaces. The transport vehicle 12 is then positioned with the first set of wheels 22 immediately above the rails 16. The second set of wheels 24 is moved from the retracted position to the extended position to permit the transport vehicle 12 to move along the rails 16.

Next, the ramp 32 is moved from the retracted position to the extended position. The rail grinding unit 14 is rolled along the rails 26, over the ramp 32 and onto the rails 16. The ramp is then moved from the extended position to the retracted position.

The tow bar 52 is attached between the transport vehicle 12 and the rail grinding unit 14. The rail grinding unit 14 is operably attached to the generator 40 with a cable (not shown).

The grinding modules 50 are extended from the rail grinding unit 14 and the grinding modules 50 are activated to affect grinding of the rails. Since the rail grinding unit 14 is attached to the transport vehicle 12, moving the transport vehicle 12 causes the rail grinding unit 14 to move along the rails 16 to grind other areas of the rails 16.

When the grinding process is completed, the rail grinding unit 14 is detached from the transport vehicle 12, the ramp 32 is moved from retracted position to the extended position, and the rail grinding unit 14 is pulled over the ramp 32 and onto the rails 26. Next, the ramp 32 is moved from the extended position to the retracted position and the second set of wheels 24 are moved from the extended position to the retracted position.

It is contemplated that features disclosed in this application, as well as those described in the above applications incorporated by reference, can be mixed and matched to suit particular circumstances. Various other modifications and changes will be apparent to those of ordinary skill.

What is claimed is:

1. A method of grinding rails comprising:

providing a transport vehicle that is capable of moving along rails and a conventional road, wherein the transport vehicle has a pair of transport rails attached thereto;

placing a rail grinding unit in a stored position on the transport rails;

moving the rail grinding unit from the stored position to a deployed position on the rails; and grinding at least one of the rails with the rail grinding unit.

2. The method of claim 1, and further comprising extending a ramp from the transport vehicle to facilitate moving the rail grinding unit from the stored position to the deployed position.

3. The method of claim 2, and further comprising moving the rail grinding unit over the ramp from the stored position to the deployed position with a winch assembly.

4. The method of claim 1, and further comprising powering operation of the rail grinding unit.

5. The method of claim 1, and further comprising towing the rail grinding unit with the transport vehicle.

6. The method of claim 1, wherein the rail grinding unit has a first group of grinding heads and second group of grinding heads, and further comprising adjusting a distance between the first group of grinding heads and the second group of grinding heads.

7. The method of claim 1, and further comprising collecting dust generated by grinding at least one of the rails.

8. The method of claim 1, and further comprising controlling sparks generated by grinding at least one of the rails.

9. The method of claim 1, and further comprising suppressing noise generated by grinding at least one of the rails.

10. The method of claim 1, and further comprising collecting dust generated by grinding at least one of the rails.

11. A rail grinding apparatus for use in grinding rails, the rail grinding apparatus comprising:

a transport vehicle that is capable of moving along the rails or a conventional road, wherein the transport vehicle has at least one transport rail attached thereto; and a rail grinding unit that is capable of grinding at least one of the rails, wherein the rail grinding unit is movable over the transport rail between a stored position on the transport vehicle and a deployed position on the rails.

12. The rail grinding apparatus of claim 11, wherein the transport vehicle includes a motor for moving the transport vehicle over the rails or the conventional road.

13. The rail grinding apparatus of claim 11, wherein the transport vehicle includes a ramp that is movable between a stored position and a deployed position, when in the deployed position, the ramp permits the rail grinding unit to be moved between the stored position and the deployed position.

14. The rail grinding apparatus of claim 13, wherein the ramp includes a first section that is pivotally mounted to the frame and a second section that is pivotally mounted to the first section.

15. The rail grinding apparatus of claim 11, wherein the transport vehicle includes a pair of transport rails on which the rail grinding unit is movable.

16. The rail grinding apparatus of claim 11, wherein the transport vehicle includes a first set of wheels for moving the transport vehicle along rails and a second set of wheels for moving the transport vehicle along the conventional road.

17. The rail grinding apparatus of claim 11, wherein the transport vehicle comprises a generator for powering the rail grinding unit.

18. The rail grinding apparatus of claim 11, wherein the transport vehicle includes a winch assembly to facilitate moving the rail grinding unit between the stored position and the deployed position.

19. The rail grinding apparatus of claim 11, wherein the rail grinding unit has a plurality of grinding modules.

20. The rail grinding apparatus of claim 19, wherein the plurality of grinding modules includes a first group of grinding modules and a second group of grinding modules, wherein a distance between the first group of grinding modules and the second group of grinding modules is adjustable.

21. A rail grinding apparatus for use in grinding rails, the rail grinding apparatus comprising:

a rail grinding unit that is capable of grinding at least one of the rails; and a motorized tow vehicle that is operably attached to the rail grinding unit for towing the rail grinding unit, wherein the motorized tow vehicle has at least one rail attached thereto for moving the rail grinding unit between a stored position on the motorized tow vehicle and a deployed position on the rails.

22. The rail grinding apparatus of claim 11, wherein the motorized tow vehicle comprises a generator for powering the rail grinding unit.

23. The rail grinding apparatus of claim 11, wherein the rail grinding unit has a plurality of grinding modules.

24. The rail grinding apparatus of claim 23, wherein the plurality of grinding modules includes a first group of grinding modules and a second group of grinding modules, wherein a distance between the first group of grinding modules and the second group of grinding modules is adjustable.

* * * * *

UNITED STATES PATENT AND TRADEMARK OFFICE

CERTIFICATE OF CORRECTION

PATENT NO. : 6,719,616 B2
DATED : April 13, 2004
INVENTOR(S) : Mathison et al.

It is certified that error appears in the above-identified patent and that said Letters Patent is hereby corrected as shown below:

Title page,
Item [*] Notice, “113” should be -- 131 --.

Column 6,
Lines 52 and 55, delete “11” and insert -- 21 --.

Signed and Sealed this

Twenty-ninth Day of March, 2005

JON W. DUDAS
*Director of the United States Patent and Trademark Office*